US006513296B1

(12) United States Patent
Baden

(10) Patent No.: US 6,513,296 B1
(45) Date of Patent: Feb. 4, 2003

(54) WALL ANCHOR FOR REINFORCING AND/ OR SECURING WALLS

(76) Inventor: Steffen Baden, Weiherwiesen 38, D-90559 Burgthann (DE)

( * ) Notice: Subject to any disclaimer, the term of this patent is extended or adjusted under 35 U.S.C. 154(b) by 0 days.

(21) Appl. No.: 09/571,955

(22) Filed: May 15, 2000

(30) Foreign Application Priority Data

May 20, 1999 (DE) ..... 199 23 080

(51) Int. Cl.[7] ..... E04B 1/02

(52) U.S. Cl. ..... 52/562; 52/699; 52/707; 411/521

(58) Field of Search ..... 52/562, 582.1, 52/698, 699, 503, 700, 707, 709; 411/34, 35, 57.1, 511, 519, 521, 352, 353

(56) References Cited

U.S. PATENT DOCUMENTS 4,883,396 A * 11/1989 Shamah et al. ..... 411/55

FOREIGN PATENT DOCUMENTS

JP 401226955 A * 9/1989 ..... 52/698

* cited by examiner

*Primary Examiner*—Carl D. Friedman
*Assistant Examiner*—Naoko Slack
(74) *Attorney, Agent, or Firm*—Jordan and Hamburg LLP

(57) ABSTRACT

A wall anchor for reinforcing and/or securing walls, comprising an elongated anchor section, which is constructed to pass through an opening of one or more bricks and at which at least one abutment is provided, which can be pushed into the opening or over which a brick can be pushed and which is braced in the opening against movement of the wall anchor or of the brick in the opposite direction.

11 Claims, 3 Drawing Sheets

WALL ANCHOR FOR REINFORCING AND/ OR SECURING WALLS

BACKGROUND OF THE INVENTION

The invention relates to a wall anchor for reinforcing and/or securing walls.

From the subsequently published patent application 199 21 873.0, wall blocks for erecting masonry are known, which at their upper side have a plurality of protruding, knob-like projections and, at their underside, appropriately positioned and appropriately shaped depressions. These wall blocks enable masonry to be erected without mortar in the joints. At each wall block, at least one opening is provided, which passes through the wall block and the position of which is selected so that the openings of several wall blocks, placed on top of one another and optionally also offset to one another, complement one another into an opening passing through the whole of the masonry. Since such wall blocks, as described, make possible stone constructions without mortar in the joints, that is, the wall blocks are not connected with one another over a layer of mortar, it is necessary, especially when erecting higher masonry, to reinforce or secure these. It is an object of the present invention to provide a wall anchor, which permits walls to be reinforced and/or secured simply and which can be set in a simple way.

SUMMARY OF THE INVENTION

This objective is accomplished by a wall anchor for reinforcing and/or securing walls consisting of an elongated anchor section, which is constructed to pass through an opening of one or more wall bricks and at which at least one abutment is provided, which can be pushed into the opening or over which a brick can be pushed and which is braced in the opening against movement of the wall anchor or of the brick in the opposite direction.

The inventive wall anchor is pushed easily with its anchor section and the thereto attached abutment into the opening, the abutment being braced in the opening against being retracted from it. The mode of operation can also be reversed, in that a brick is pushed over an already set wall anchor, the abutment, over which the brick is then pushed, in this case also being wedged in the opening. At the anchor section, only one abutment may be provided which, for example, is positioned in a lower region of the masonry that is to be erected. The longitudinal anchor section then extends through the openings of the masonry as a whole, which are aligned with one another, and protrudes from the upper side. This makes it possible to provide a fastening section at this free piece for a roof beam or the like, which extends horizontally with respect to the masonry. Of course, it is also possible to provide several abutments at the wall anchor, which act in opposite directions with respect to a movement of the brick or anchor and, in this way, secure and reinforce the whole of the masonry.

The abutment or abutments may be constructed claw-shaped or hookshaped, as long as adequate bracing is made possible by these means. It is particularly appropriate if the abutment or abutments are constructed disk-shaped, since a large contacting surface between the edge of the abutment and the inner wall of the opening results from these means. In this case, it has proven to be advantageous for improving the bracing if, pursuant to the invention, one or more slots or the like are provided for making possible an elastic contact between the abutment and the inner wall. Moreover, the abutment or abutments can be pre-molded for bracing at the inner wall of the opening, for example, in the form of a truncated cone or conically for a circular opening or in the form of a truncated pyramid in the case of a rectangular opening. Alternatively, it is also possible to construct the abutments so that they can be deformed appropriately while being pushed into the opening. Pursuant to the invention, the abutment or abutments itself or themselves can be fixed irremovably to the anchor section, for example, by welding. Alternatively, a removable fastening is also possible, so that the abutment is only set in case of need. For fastening the abutment, at least one seat for a fastening splint or bolt can be provided at the anchor section. It has proven to be appropriate to dispose several seats, distributed over the length of the anchor section, in order to specify certain possible choices with respect to positioning the abutment or abutments.

It has been described above that the wall anchor passes through the masonry over a considerable distance, especially in the case of higher masonry. Consequently, the wall anchor must be correspondingly long. It has therefore proven to be advantageous if the wall anchor, pursuant to the invention, consists of two anchor parts with one anchor section each, which can be connected together. The anchor section accordingly is divided into two and can be extended by the user, if required. This has proven to be advantageous also for transporting reasons. At the same time, a connecting section may be provided at one end of each anchor section. The connecting sections can be connected together by means of connecting elements. Alternatively, pursuant to the invention, a connecting section may be provided at one anchor section part and a connecting element, which can be connected with the connecting section, provided at the other section part. Therefore, in one case, the connecting element is a separate component and, in the other, it is connected firmly with an anchor section part. The connecting section or sections and the connecting element can interact in the form of a plug-in/locking piece coupling. However, from a manufacturing point of view, it has proven to be advantageous if the inventive connecting section is constructed as a threaded section and the connecting element as a threaded sleeve.

Pursuant to the invention, the anchor section and/or the abutment or abutments and/or the connecting element may consist of metal and especially of steel. A version in plastic is also possible.

Aside from the wall anchor itself, the invention furthermore relates to equipment for loosening a set wall anchor of the type described above. Pursuant to the invention, this comprises a sleeve-like insertion section for insertion into the opening of a brick and for accommodating the abutment, which can be compressed by means of the leading edge of the insertion section and detached from its braced position at the inner wall of the opening. This equipment very advantageously enables a braced abutment to be loosened, so that the wall block, braced by the abutment, can be loosened from the reinforced or secured masonry composite and pulled off. Since the masonry has no mortar in the joints, it can easily be removed completely by these means. To make the compression of the abutment simple, the inner edge of the leading edge should be sloped. Furthermore, it has proven to be advantageous for this if the external diameter of the insertion section, the cross-sectional shape of which is adapted to the opening, is only insignificantly smaller than the internal diameter of the opening, so that the leading edge of the insertion section can engage the edge of the abutment over as large an area as possible. The length of the insertion section should correspond at least to the depth of the opening. Pursuant to the invention, to make the handling of the equipment easy, laterally protruding, detachable handling sections are provided. The equipment may also consist of metal or plastic.

Further advantages, distinguishing features and details of the invention arise out of the examples described in the following as well as from the accompanying drawings.

IN THE DRAWINGS

Figure 1:
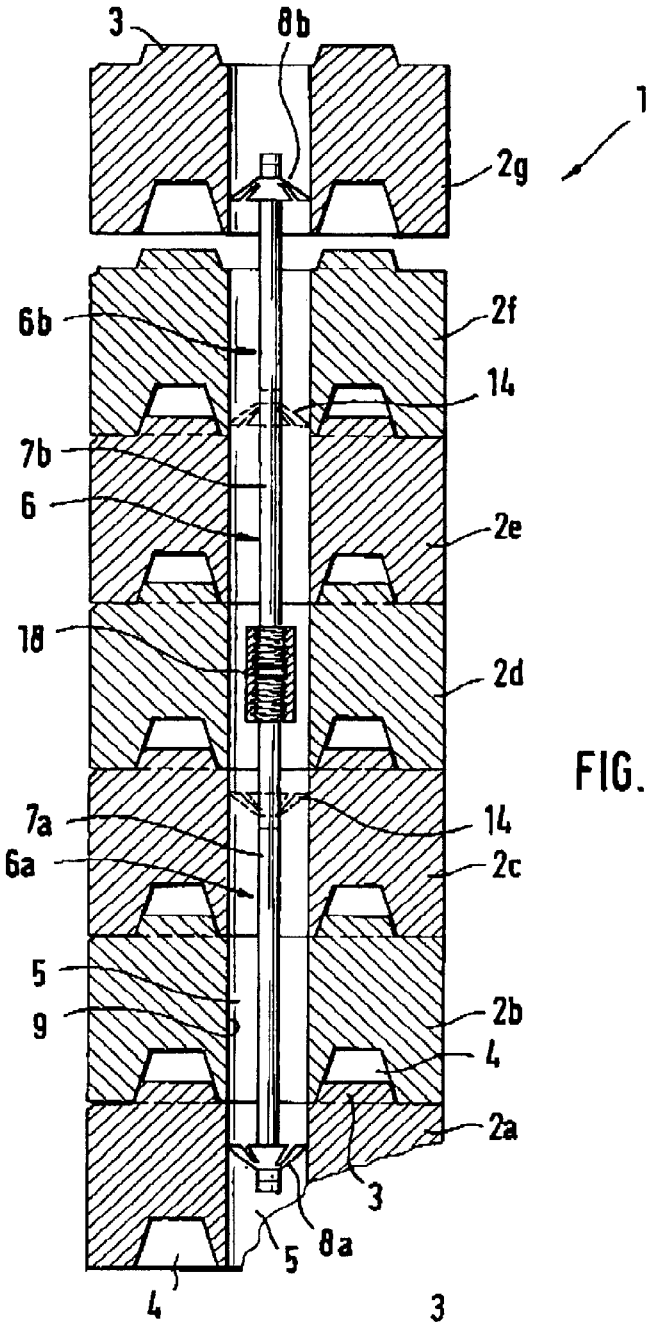
FIG. 1 shows a sectional view through masonry with a set wall anchor.
Figure 2:
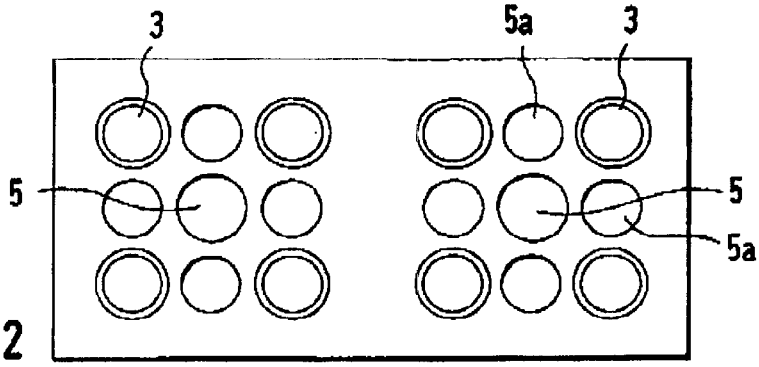
FIG. 2 shows a plan view of a wall block forming the masonry of FIG. 1.
Figure 3:
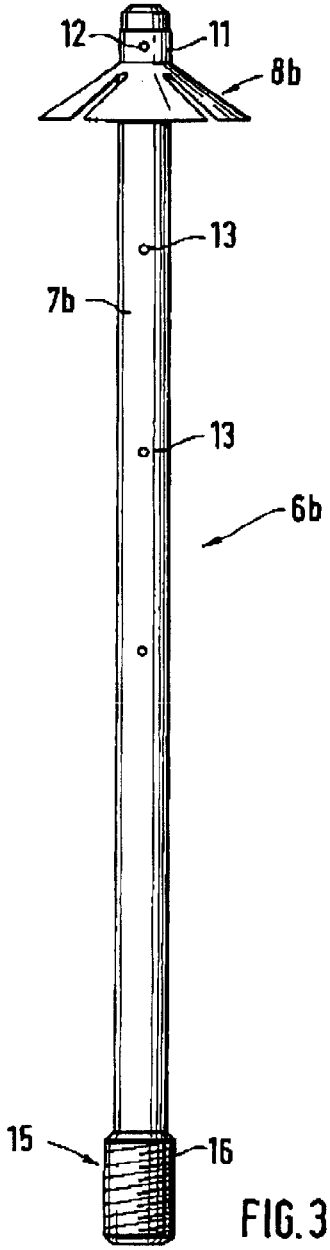
Figure 5:
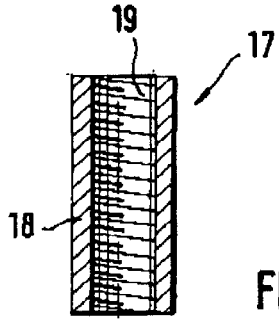
Figure 6:
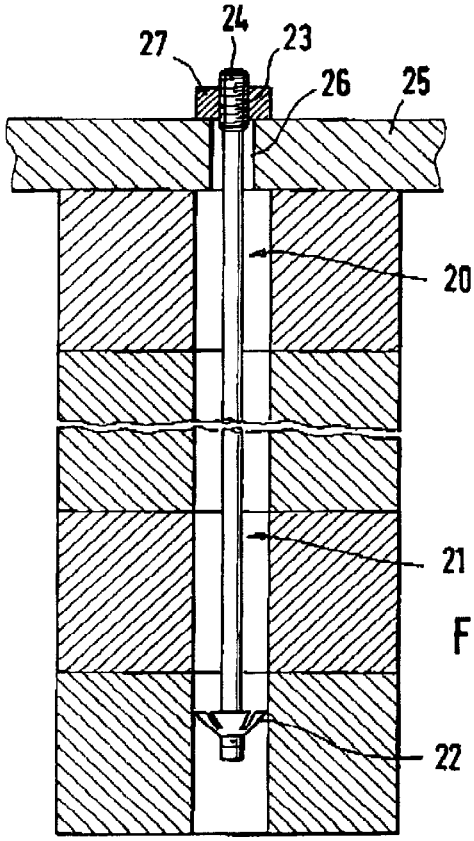
Figure 4:
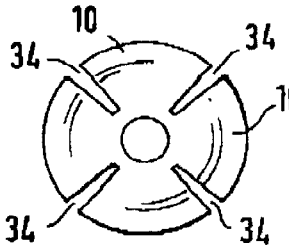
Figure 7:
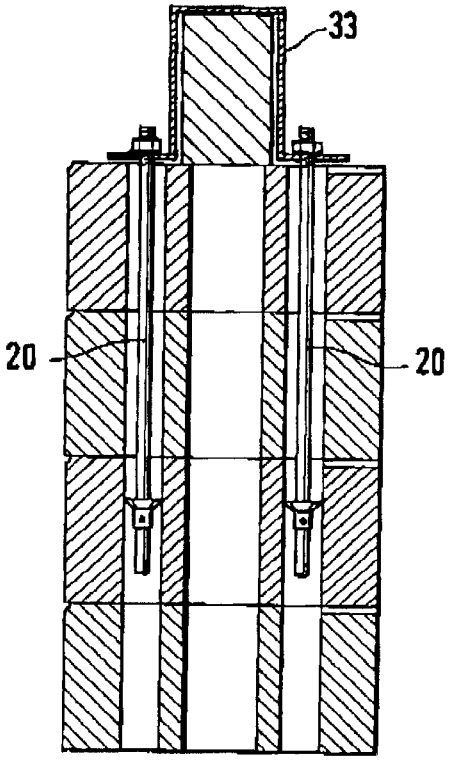
Figure 8:
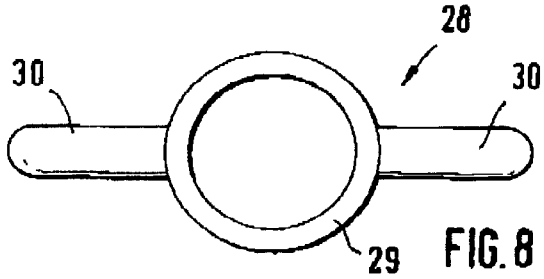
Figure 9:
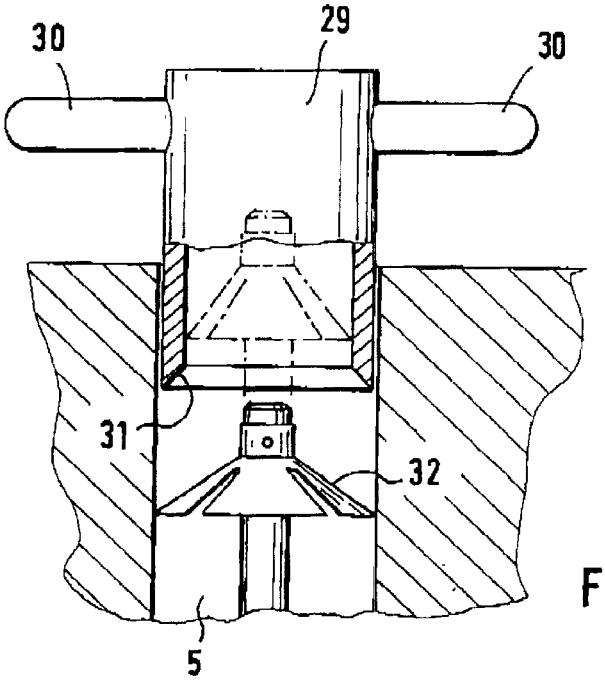

FIG. 3 shows a side view of an anchor part of the wall anchor of FIG. 1, consisting of two parts, FIG. 4 shows a plan view of a disk-shaped abutment, FIG. 5 shows a side view of a connecting element for connecting two parts of a wall anchor, FIG. 6 shows a sectional view through masonry with a set one-piece anchor, FIG. 7 shows a side view through masonry with two anchors, at which a common fastening part is disposed, FIG. 8 shows a plan view of equipment for loosening an abutment, and FIG. 9 shows a side view, partially in section, of equipment introduced into a wall block for loosening an abutment.

DESCRIPTION OF THE PREFERRED EMBODIMENTS

FIG. 1 shows masonry 1 consisting of wall blocks 2*a*–2*g*, which are placed on top of one another and optionally positioned offset to one another, wall block 2*g* being in the process of being set. Each wall block, at its upper side, has a series of knob-like, truncated cone-like projections 3 and, at its underside, correspondingly positioned depressions 4. Each wall block 2*a*–2*g* has two openings 5 of circular cross section, which pass through it, as well as further openings 5*a* in the example shown. The openings 5 (and also the openings 5*a*) are positioned so that the openings of two wall blocks, one of which is above the other, complement one another as shown in FIG. 1. Into the resulting opening, which passes through the whole of the masonry 1 and is shown in FIG. 1, a wall anchor 6 is inserted, which consists of two anchor parts 6*a* and a 6*b*. Each anchor part 6*a*, 6*b* has an elongated anchor section 7*a*, 7*b*. As shown in FIG. 1, an abutment 8*a*, 8*b* is disposed at each of these anchor sections. The respective abutment is constructed and dimensioned so that it is wedged at the inner wall 9 of the opening 5 of a respective wall block. This means that it can be pushed into the opening from one direction but no longer pulled out in the opposite direction.

If now a wall anchor 6 is to be set, then this can be done, for example, in the following manner.

To begin with, the lowest wall block 2*a*, for example, is placed on a foundation. Subsequently, the masonry is raised up until wall block 2*c* is set. The wall anchor 6 is now pushed from above with the abutment 8*a* in front into the resulting opening 5. The disk-shaped abutment 8*a* may already be pre-shaped conically; alternatively, it may also be deformed appropriately while being pushed in. During the pushing in, the abutment 8*a* slides along the inner wall 9 of the opening. Once the wall anchor reaches the end position, the abutment 8*a* becomes wedged and the wall anchor 6 can no longer be pulled out in the upward direction. Subsequently, the masonry is stacked up further. At the upper end of the wall anchor 6, there is the abutment 8*b* which, as shown in FIG. 1, is fastened in an arrangement the reverse that of abutment 8*a*. This means that a wall block can be pushed downward over this abutment 8*b*, but can no longer be pulled up over it. For raising the wall, bricks 2*d*, 2*e* and 2*f* are now pushed over the abutment 8*b*. If the wall block 2*g* is set, the abutment 8*b* also slides along its inner wall 9, until the wall block 2*g* lies in its end position on wall block 2*f* and the abutment 8*b* is finally wedged in its end position. The masonry 1, stacked up from the wall blocks 2*a*–2*g*, is thus completely secured and reinforced. Of course, it should be noted that the procedure can also be different. As described, the wall anchor 6 consists of two anchor parts, which are connected with one another. This makes it possible, for example, after setting the wall block 2*a*, initially to set the lower anchor part 6*a*, then to raise the wall and, after setting the wall block 2*c*, finally to fix the upper anchor part 6*b*, after which the masonry can be erected further. At the same time, the possibility exists of initially not putting in place the abutment 8*b*, which can be mounted detachably, and of fastening it only when the wall block 2*g* is to be set. It is also possible to raise the wall initially up to the wall block 2*f* and then to set the wall anchor 6. This means that the abutment is pushed from above until the very bottom. Only then is the last wall block 2*g* set.

FIG. 3 shows an enlarged view of the anchor part 6*b* of FIG. 1. At the upper end, there is the abutment 8*b* which, in the example shown (FIG. 4), is pre-formed disk-shaped and conically and has several slots 34, which make the abutment section 10 slightly elastic. By these means, the bracing effect is improved. As shown in FIG. 3, the abutment 8*b* has a cylindrical fastening section 11 with a fastening borehole 12, through which a fastening splint or bolt, which is not shown, can be pushed for the removable fastening of the abutment 8*b* at the anchor section 7*b*. The fastening splint or bolt engages an appropriate seat 13 in the form of a borehole, of which several are distributed over the length of the anchor section 7*b*.The abutment 8*b* can thus be set at any time and in any position, which is determined by the position of the respective seat 13. Furthermore, the possibility exists of providing several abutments in an appropriate similar alignment at the anchor section part, as indicated in FIG. 1 by means of the abutments 14 shown by broken lines.

At the lower end, a connecting section 15 is provided in the form of a threaded section 16. A corresponding section is also formed at the other anchor part. Both are intended for combining the anchor parts with one another. For this purpose, the connecting element 17 is used, which is shown in FIG. 5 and is in the form of a threaded sleeve 17, which has an internal thread 19, into which the threaded section 16 can be screwed.

FIG. 6 shows a further embodiment of an inventive wall anchor 20. This wall anchor 20 has only a one-piece elongated anchor section 21, at the lower end of which, as shown in the example, an abutment 22 is provided. At the upper end of the anchor section 21, a fastening section 23 with an external thread 24 is provided. The latter makes it possible to fasten a third object 25, such as a beam of a roof truss, which is shown in the example and extends transversely to the masonry shown. The anchor section passes through the third object in an appropriate borehole 26 and can be supported at the top by means of a nut 27. By these means also, the masonry, which is secured at the underside by abutment 22, is secured and reinforced.

FIG. 7 shows masonry, into each of the continuous openings of which, formed by the further openings 5*a*, a wall anchor 20 is set. The third object shown there, such as a beam, is fastened here by means of an essentially U-shaped holding clamp 33, which embraces the beam and is bolted by means of nuts to the fastening sections of the wall anchor 20.

Finally, FIGS. 8 and 9 show equipment 28 for loosening a set wall anchor or for loosening an abutment. This comprises a sleeve-like insertion section 29, the external diameter of which (see FIG. 8) is only insignificantly smaller than the internal diameter of opening 5 (optionally of an opening 5*a*) of a wall block. At the insertion section 29, two detachable, for example, bolted handling sections 30 are provided. For the purpose of loosening, the insertion section 29 is now pushed from above into the opening 5. The sloping front edge 31 of the insertion section 29 comes into contact with the abutment 32 and, upon further insertion, compresses this, as a result of which it is loosened from its bracing with the inner wall of the opening 5. The abutment 32, as shown by the broken line in FIG. 8, is then taken up in the interior of the insertion section 29 and braced there. If now the handling sections 30 are removed, the wall block can be pulled out upward over the sleeve. In a corresponding manner, the wall blocks below, which are not connected with one another since the masonry contains no mortar in the joints, can also be pulled off. Alternatively, the possibility exists of lowering the insertion section 29 even further until the abutment 32 emerges once again from the upper side. The abutment can then be loosened from the anchor section, after which the masonry can be removed further.

What is claimed is:

1. A wall anchor for securing at least one wall part in which the wall part has at least one opening comprising:

an elongated anchor unit extending through the opening of the wall part;

an abutment on said elongated anchor unit constructed to provide for relative movement between said elongated anchor unit and said opening in one longitudinal direction and to preclude relative movement between said elongated anchor unit and said opening in an opposite longitudinal direction; and an affixing device for detachably affixing said abutment to said anchor unit.

2. A wall anchor according to claim 1 wherein said affixing device includes a seat part on said elongated anchor unit and an elongate attachment element engageable with said seat part.

3. A wall anchor according to claim 2 including a plurality of said seat parts spaced along the longitudinal length of said elongated anchor unit.

4. Wall anchor apparatus for securing and unsecuring wall parts in which the wall parts have openings for the wall anchor apparatus, comprising an elongated anchor unit extending through the openings of the wall parts, an abutment on said elongated anchor unit constructed to provide for relative movement between said elongated anchor unit and said openings in one longitudinal direction and to preclude relative movement between said elongated anchor unit and said openings in an opposite longitudinal direction, an insertion sleeve unit insertable in said opening in the wall parts in said opposite longitudinal direction for engaging said abutment and for removing said engaged abutment from said opening by moving said insertion sleeve unit in said one longitudinal direction.

5. Wall anchor apparatus according to claim 4 wherein said insertion sleeve unit flexes said abutment radially inwardly.

6. Wall anchor apparatus according to claim 4 wherein said insertion sleeve unit has a leading end portion which has a partial conical configuration.

7. Wall anchor apparatus according to claim 4 wherein said insertion sleeve unit has an external diameter substantially as great as the diameter of said opening in said wall part.

8. Wall anchor apparatus according to claim 4 wherein the longitudinal length of said insertion sleeve unit is at least as long as the longitudinal length of said opening.

9. Wall anchor apparatus according to claim 4 comprising a lateral precluding handle on said insertion sleeve unit.

10. Wall anchor apparatus according to claim 4 wherein said insertion sleeve unit is made of metal.

11. Wall anchor apparatus according to claim 4 wherein said insertion sleeve unit is made of plastic.

* * * * *